US008277034B2

(12) United States Patent
Murray et al.

(10) Patent No.: US 8,277,034 B2
(45) Date of Patent: Oct. 2, 2012

(54) ORIENTATION OF AIR-PERMEABLE MEMBRANE IN INKJET PRINTHEAD

(75) Inventors: Richard A. Murray, San Diego, CA (US); Gary A. Kneezel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 358 days.

(21) Appl. No.: 12/750,749

(22) Filed: Mar. 31, 2010

(65) Prior Publication Data

US 2011/0242238 A1 Oct. 6, 2011

(51) Int. Cl.
*B41J 2/19* (2006.01)

(52) U.S. Cl. ..... 347/92; 347/97; 347/85; 347/93

(58) Field of Classification Search ..... 347/92, 347/97, 85, 93
See application file for complete search history.

(56) References Cited

U.S. PATENT DOCUMENTS

| | | | | |
|---|---|---|---|---|
| 7,491,258 | B2 | 2/2009 | Gouzou et al. | |
| 8,038,269 | B2 * | 10/2011 | Umeda | 347/85 |
| 2007/0046747 | A1 * | 3/2007 | Takemoto | 347/92 |

OTHER PUBLICATIONS

R. A. Murray, "Air Extraction Printer", U.S. Appl. No. 12/614,481, filed Nov. 9, 2009.

* cited by examiner

*Primary Examiner* — Ellen Kim
(74) *Attorney, Agent, or Firm* — Peyton C. Watkins

(57) ABSTRACT

An inkjet printhead assembly for use in an inkjet printer, the inkjet printhead assembly includes an array of nozzles disposed along a nozzle array direction; an ink chamber including an ink outlet that is fluidly connected to the array of nozzles; and an air-permeable membrane positioned in the ink chamber at an angle that is inclined relative to the nozzle array direction.

23 Claims, 19 Drawing Sheets

ORIENTATION OF AIR-PERMEABLE MEMBRANE IN INKJET PRINTHEAD

FIELD OF THE INVENTION

The present invention relates generally to an inkjet printhead assembly having an air permeable membrane to assist in removing excess air from ink chambers of the printhead assembly, and more particularly to a mounting orientation for the membrane.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge so that the printhead needs to be replaced when the ink is depleted, or the ink tank can be detachably mounted to the printhead so that only the ink tank itself needs to be replaced when the ink is depleted. Carriage mounted ink tanks typically contain only enough ink for up to about several hundred prints. This is because the total mass of the carriage needs be limited so that accelerations of the carriage at each end of the travel do not result in large forces that can shake the printer back and forth. As a result, users of carriage printers need to replace carriage-mounted ink tanks periodically depending on their printing usage, typically several times per year. Consequently, the task of replacing a detachably mounted ink tank should be simple and reliable within the printer.

Inkjet ink includes a variety of volatile and nonvolatile components including pigments or dyes, humectants, image durability enhancers, and carriers or solvents. A key consideration in ink formulation and ink delivery is the ability to produce high quality images on the print medium. Image quality can be degraded if air bubbles block the small ink passageways from the ink supply to the array of drop ejectors. Such air bubbles can cause ejected drops to be misdirected from their intended flight paths, or to have a smaller drop volume than intended, or to fail to eject. Air bubbles can arise from a variety of sources. Air that enters the ink supply through a non-airtight enclosure can be dissolved in the ink, and subsequently be exsolved (i.e. come out of solution) from the ink in the printhead at an elevated operating temperature, for example. Air can also be ingested through the printhead nozzles. For a printhead having replaceable ink supplies, such as ink tanks, air can also enter the printhead when an ink tank is changed.

Commonly assigned U.S. patent application Ser. No. 12/614,481 discloses removal of air from the ink in a printhead, by applying reduced pressure (for example, using a bellows pump) to an air extraction device. An air passageway is provided between the air extraction device and the ink chambers of the printhead. An air permeable membrane is disposed at the top of each ink chamber, so that air can be transferred from the ink chamber to the air extraction device, but liquid ink cannot. In some instances, for example if the printer is moved from a horizontal orientation or jostled excessively, it is possible for liquid ink to slosh onto the air permeable membranes. If the liquid is not removed from the air permeable membrane, it can impede the effectiveness of air removal through the membrane.

U.S. Pat. No. 7,491,258 discloses a gas and liquid separation device for use with a fuel tank of an automobile. The gas and liquid separation device includes a membrane that is oriented at an angle with respect to the horizontal to facilitate draining of liquid off the membrane so that gaseous fuel is passed through the membrane effectively. It is indicated that preferably the membrane is oriented near vertical (i.e. substantially or approximately 90 degrees with respect to horizontal).

What is needed is an inkjet printhead assembly including an ink chamber having an ink outlet that is fluidly connected to an array of nozzles, and an air-permeable membrane that is positioned in the ink chamber to facilitate removal of liquid ink to keep it from adhering and blocking the membrane, as well as a compact design. For the case of a carriage printer, an orientation of the membrane is preferred that facilitates removal of liquid ink during carriage acceleration and deceleration.

SUMMARY OF THE INVENTION

The present invention is directed to overcoming one or more of the problems set forth above. Briefly summarized, according to one aspect of the invention, the invention resides in an inkjet printhead assembly for use in an inkjet printer, the inkjet printhead assembly comprising an array of nozzles disposed along a nozzle array direction; an ink chamber including an ink outlet that is fluidly connected to the array of nozzles; and an air-permeable membrane positioned in the ink chamber at an angle that is inclined relative to the nozzle array direction.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
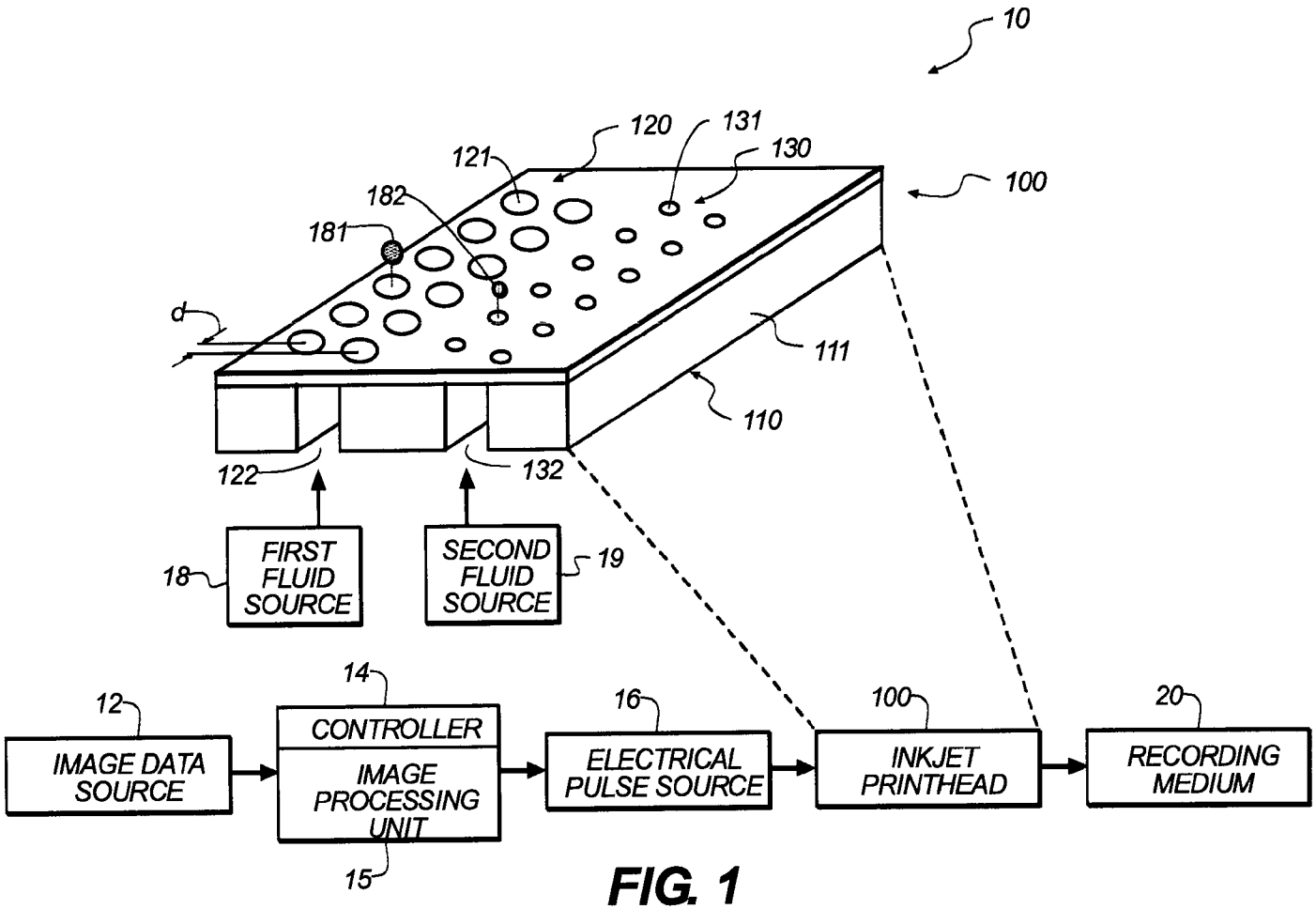
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. Each nozzle array is supplied by a fluid source. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
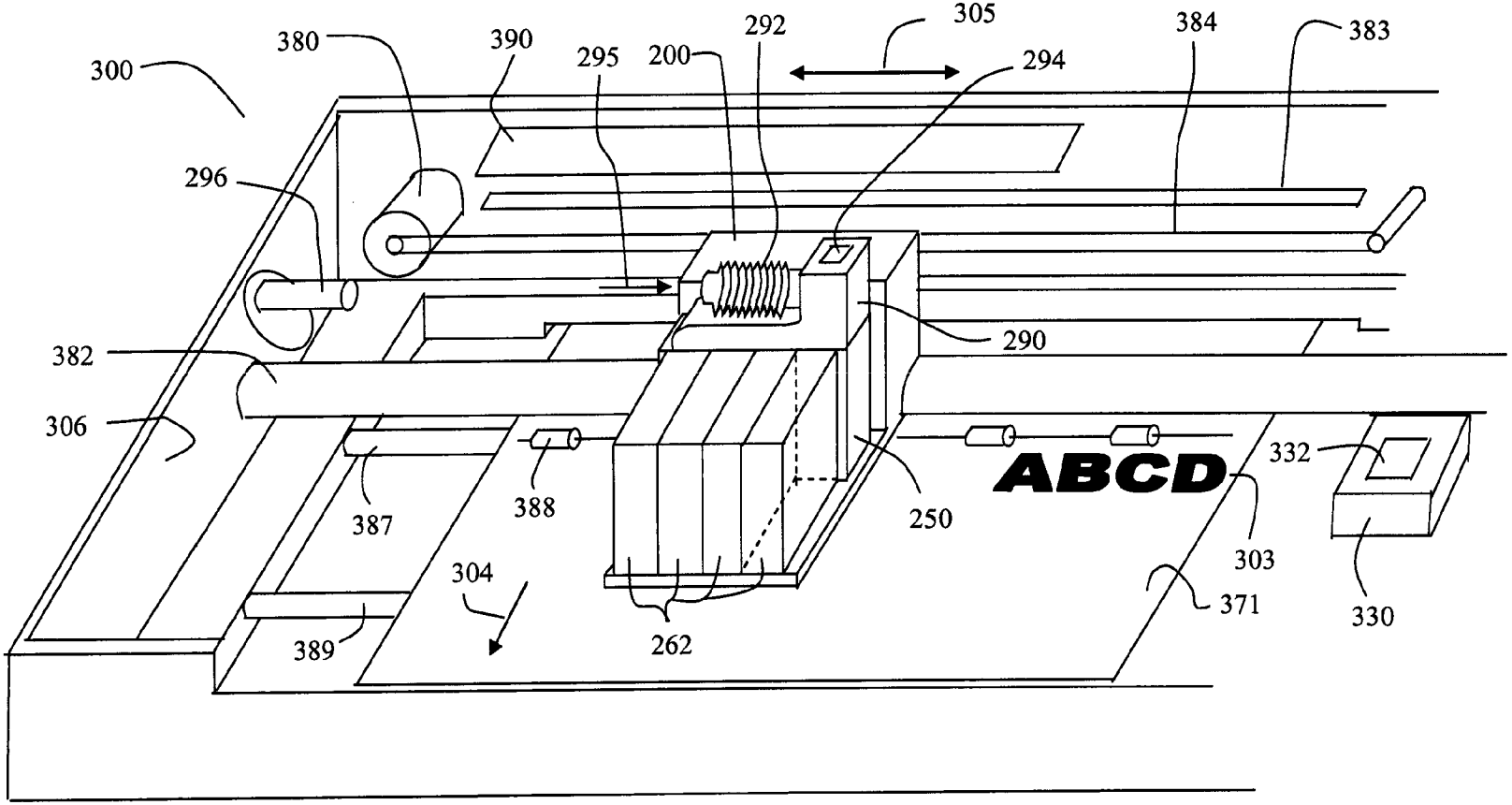
FIG. 2 is a schematic perspective view of a portion of a carriage printer.

FIG. 2 shows a schematic perspective view of a portion of a desktop carriage printer 300. Some of the parts of the printer have been hidden in the view shown in FIG. 2 so that other parts can be more clearly seen. Printer 300 has a print region 303 across which carriage 200 is moved back and forth in carriage scan direction 305 (also called carriage guide direction herein), while drops of ink are ejected from a printhead that is mounted on carriage 200. Printhead frame 250 can be attached to carriage 200 or it can be integrally formed with carriage 200. One or more printhead die having associated nozzle arrays (not shown in FIG. 2) are mounted on printhead frame 250. The letters ABCD indicate a portion of an image that has been printed in print region 303 on a piece of paper or other recording medium 371. Carriage motor 380 moves belt 384 to move carriage 200 back and forth along carriage guide rod 382. At the end of travel in each direction, the carriage decelerates, stops, reverses direction, and accelerates to a substantially constant velocity. Thus, at opposite ends of travel of carriage 200, printhead frame 250 is exposed to forces in opposite directions due to carriage deceleration and acceleration in opposite senses at the opposite ends of travel. The magnitude of the acceleration and deceleration of the carriage at the ends of travel can be approximately one to three times the acceleration g due to gravity, but these carriage accelerations and decelerations typically occur for only about a tenth of a second or less. An encoder sensor (not shown) is mounted on carriage 200 and indicates carriage location relative to an encoder strip 383.

Ink tanks 262 are mounted to supply ink to printhead frame 250, and contain inks such as cyan, magenta, yellow and black, or other recording fluids. Optionally, several ink tanks can be bundled together as one multi-chamber ink supply, for example, cyan, magenta and yellow. Inks from the different ink tanks are provided to different nozzle arrays as described in more detail below.

A variety of rollers are used to advance the recording medium through the printer. Feed roller 387 and passive roller(s) 388 advance piece of recording medium 371 along media advance direction 304, which is substantially perpendicular to carriage scan direction 305 across print region 303 in order to position the recording medium for the next swath of the image to be printed. Discharge roller 389 continues to advance piece of recording medium 371 toward an output region where the printed medium can be retrieved. Star wheels (not shown) hold piece 371 of recording medium against discharge roller 389.

Toward the rear of the printer chassis 300, in this example, is located the electronics board 390, which includes cable connectors for communicating via cables (not shown) to the printhead frame 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Toward the right side of the printer 300, in the example of FIG. 2, is the maintenance station 330. Maintenance station 330 can include a wiper (not shown) to clean the nozzle face of the printhead, as well as a cap 332 to seal against the nozzle face in order to slow the evaporation of volatile components of the ink.

A way to remove air from the printhead is shown in FIG. 2 and discussed in more detail in commonly assigned U.S. patent application Ser. No. 12/614,481. Air extraction device 290 is attached to printhead frame 250. A compressible member such as a bellows 292 is part of air extraction device 290. As bellows 292 is compressed, it forces air out of the air extraction device 290 through one-way relief valve 294. Bellows 292 is configured such that it tends to expand from its compressed state. As bellows 292 expands, it provides a reduced air pressure in the air extraction device 290, which extracts air from ink chambers of printhead frame 250 as discussed in more detail below. Bellows 292 is mounted so that it is compressible along a compression direction 295 substantially parallel to carriage scan direction 305. Bellows 292 is in line with a compressing member, such as a projection 296 extending, for example, from a wall 306 of printer 300. In order to compress bellows 292, carriage 200 is moved toward wall 306 until projection 296 engages bellows 292. Because the position of carriage 200 is tracked relative to encoder strip 383, the amount of movement of carriage 200 toward wall 306 can be precisely controlled, thereby controlling the amount of compression of bellows 292 by projection 296 as the carriage moves toward wall 306. Carriage 200 can be controlled to move bellows 292 to a predetermined position relative to projection 296, such that carriage 200 is moved by a predetermined distance after the bellows 292 strikes projection 296. Controller 14 (see FIG. 1) can include instructions to determine when it should send a signal to carriage motor 380 to move carriage 200 toward wall 306 to engage projection 296 with bellows 292 for compression. After the desired amount of compression of bellows 292 has been achieved, controller 14 can send a signal to carriage motor 380 to move carriage 200 away from the wall 306. Bellows 292 can remain partially in compression for an extended period of time as it slowly expands, thereby continuing to provide a reduced air pressure in air extraction device 290.

Figure 3:
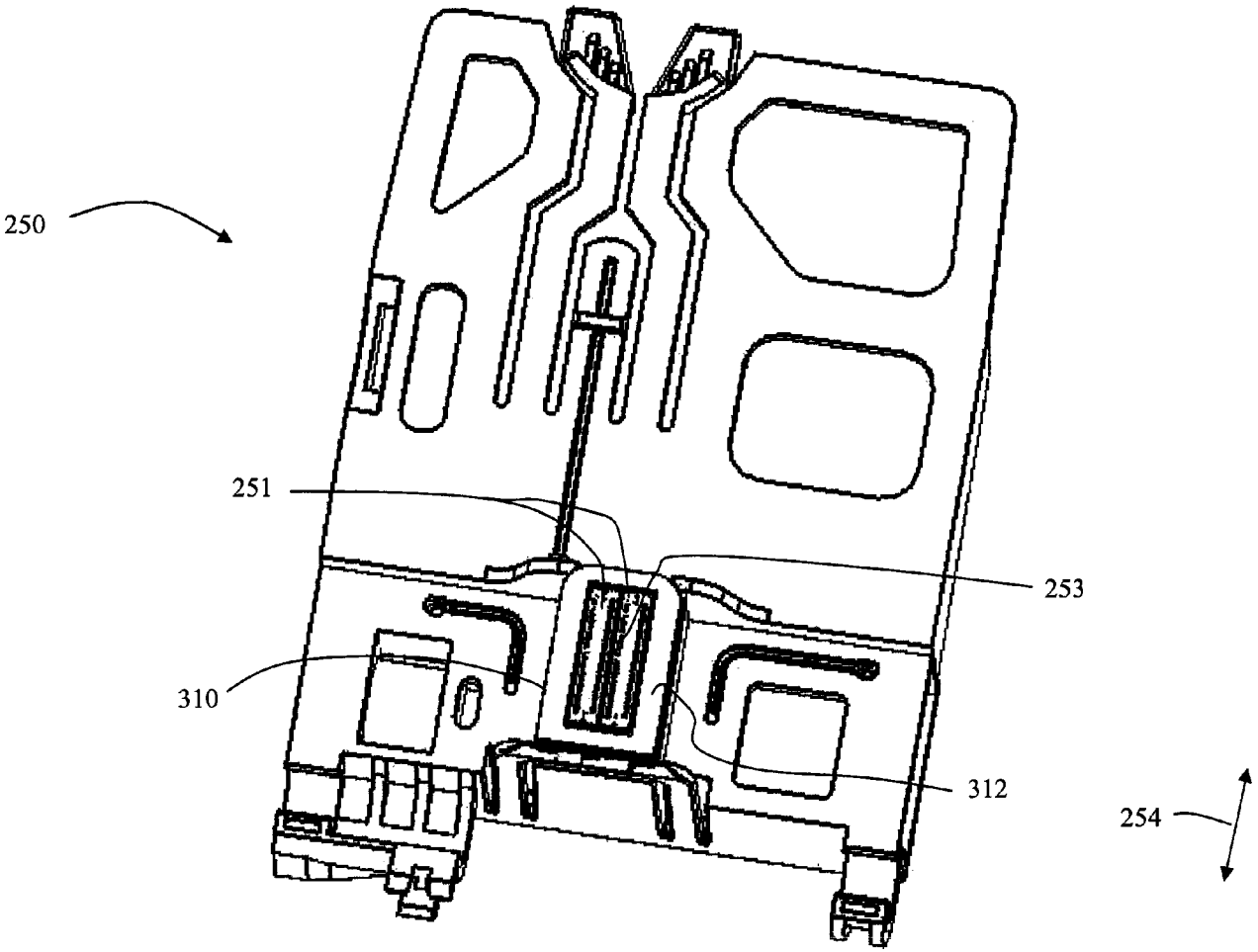
FIG. 3 is a bottom perspective view of a printhead assembly.

FIG. 3 shows a bottom perspective view of a printhead assembly. The printhead assembly includes printhead frame 250, as well as two printhead die 251 (similar to printhead die 110 in FIG. 1) mounted on die mount surface 312 of die mount substrate 310. Each printhead die 251 contains two nozzle arrays 253, so that printhead assembly 250 contains four nozzle arrays 253 altogether. The four nozzle arrays 253 in this example can each be connected to separate ink sources (not shown in FIG. 3); such as cyan, magenta, yellow, and black. Each of the four nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead across the recording medium. Following the printing of a swath, the piece of recording medium 371 is advanced along a media advance direction 304 (FIG. 2) that is substantially parallel to nozzle array direction 254.

Figure 4:
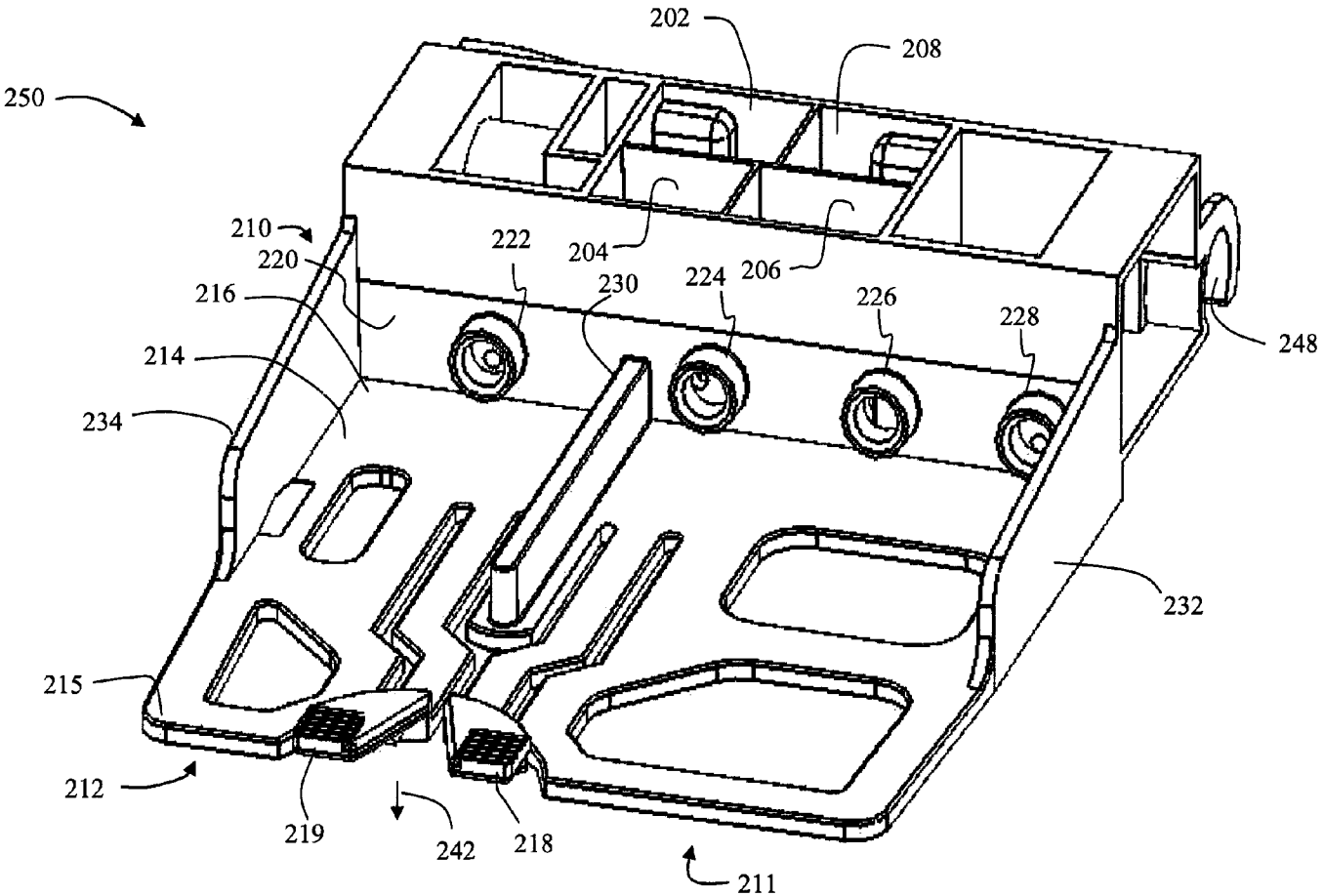
FIG. 4 is a perspective view of a printhead frame including ink chambers and a holding receptacle for two detachable ink tanks.
Figure 5:
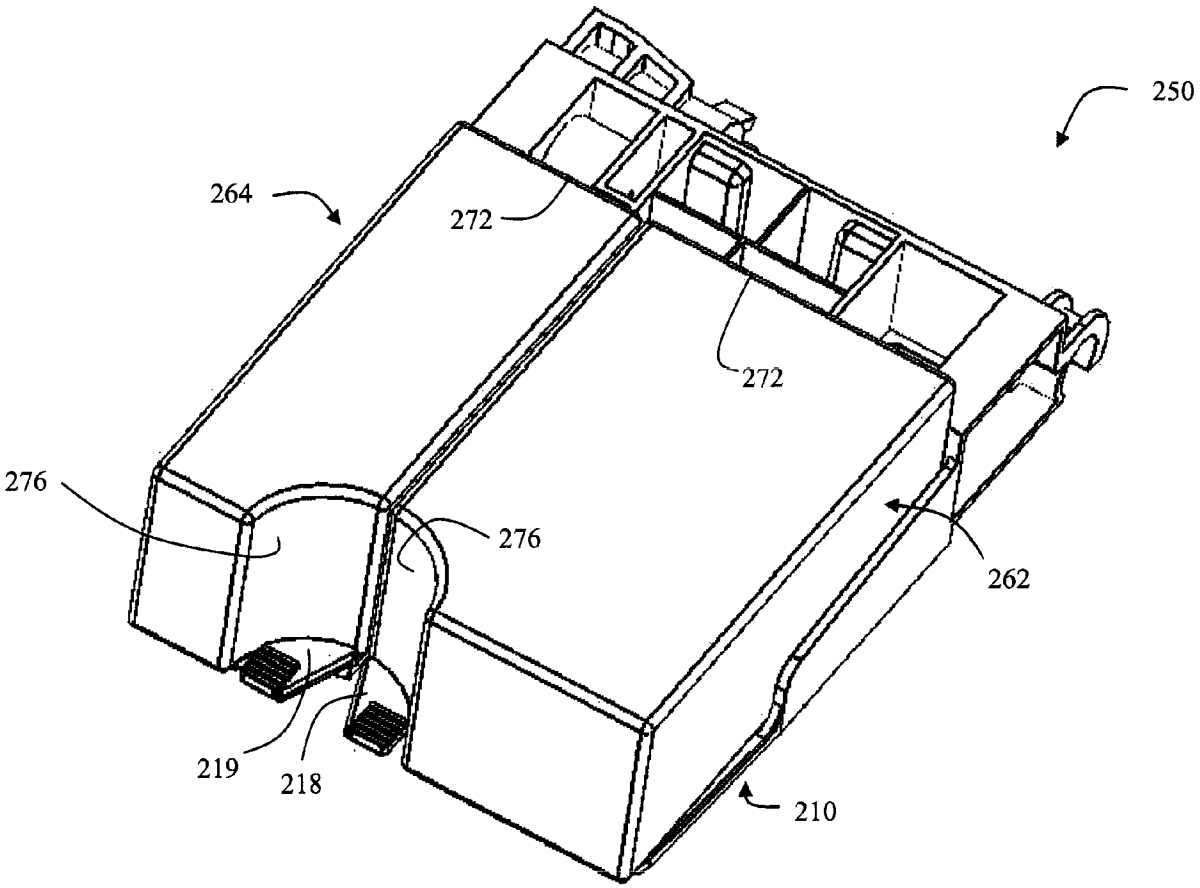
FIG. 5 is a perspective view of the printhead frame of FIG. 4 with two detachable ink tanks installed in the holding receptacle.

FIG. 4 shows a front perspective view of printhead frame 250, including holding receptacle 210 for ink tanks 262 and 264 (see FIG. 5). As described in more detail in commonly assigned U.S. patent application Ser. No. 12/750,729, holding receptacle 210 includes a first part 211 for holding a multi-chamber ink tank 262 and a second part 212 for holding a single chamber ink tank 264. Holding receptacle 210 has a base surface 214 for supporting the ink tanks. Base surface 214 has a first end 215 and a second end 216 that is opposite first end 215. Tank latch 218 is located near the first end 215 of the base surface 214 of first part 211 of holding receptacle 210, and tank latch 219 is located near the first end 215 of the base surface 214 of second part 212 of holding receptacle 210 for retaining the respective ink tanks. Wall 220 is located near the second end 216 of base surface 214 and adjoins base surface 214. Wall 220 includes ink inlet ports 224, 226 and 228 corresponding to first part 211 of holding receptacle 210, and also includes ink inlet port 222 corresponding to second part 212 of holding receptacle 210. Ink inlet ports 222, 224, 226 and 228 are connected to ink chambers 202, 204, 206 and 208. The air permeable membranes (not shown in FIG. 4) of the invention are located within the ink chambers as is described in more detail below. The ink inlet ports are configured to receive ink from ink tanks 262 and 264 through ink outlet ports (not shown) at end walls 272 of ink tanks 262 and 264. Partition 230 adjoins both base surface 214 and wall 220, and is located between a portion of first part 211 and a portion of second part 212 of holding receptacle 210. First sidewall 232 of holding receptacle 210 also adjoins both base surface 214 and wall 220. Second sidewall 234 of holding receptacle 210 is opposite first sidewall 232 and is substantially parallel to it. Partition 230 is located between first sidewall 232 and second sidewall 234. Partition 230 adjoins wall 220 between ink inlet port 222 and ink inlet port 224. Tank latches 218 and 219 are cantilevered latches that extend from base surface 214 and latch against walls 276 of ink tanks 262 and 264 respectively. If cantilevered latch 218 or 219 is depressed along pressing direction 242, it can be relocated to an unlatching position, which is below base surface 214.

In some embodiments for a carriage printer, printhead frame 250 also has at least one bearing surface 248, which can be integrally formed together with holding receptacle 210. Bearing surface 248 is intended to ride on a carriage guide in the carriage printer, so that printhead frame 250 also serves as the carriage. In fact, all of the labeled features in FIG. 3 can be integrally formed, for example, in a single injection molding step. This decreases the cost of forming and assembling the printhead and carriage, while retaining the required functionality. It can also make the design more compact.

Figure 6:
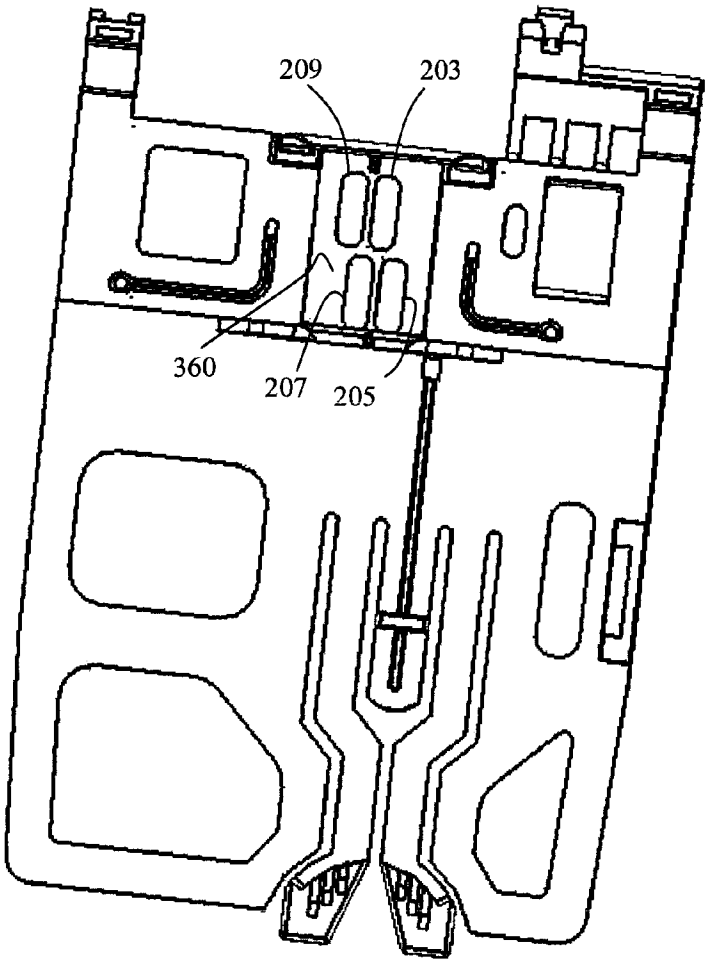
FIG. 6 is a bottom view of a printhead frame.

Ink chambers 202, 204, 206 and 208 have corresponding ink chamber outlets 203, 205, 207 and 209 respectively for delivering ink to an ink delivery surface 360 shown in FIG. 6. As shown in FIG. 3, printhead die 251 are mounted on die mount substrate 310, which is attached to printhead frame 250 in a location next to ink delivery surface 360. As is detailed in commonly assigned U.S. patent application Ser. No.12/750,744, slot openings in an ink receiving surface of die mount substrate 310 are aligned to the corresponding ink chamber outlets (also called ink delivery openings), so that the nozzle arrays 253 are fluidly connected to corresponding ink chamber outlets 203, 205, 207 and 209.

Figure 7:
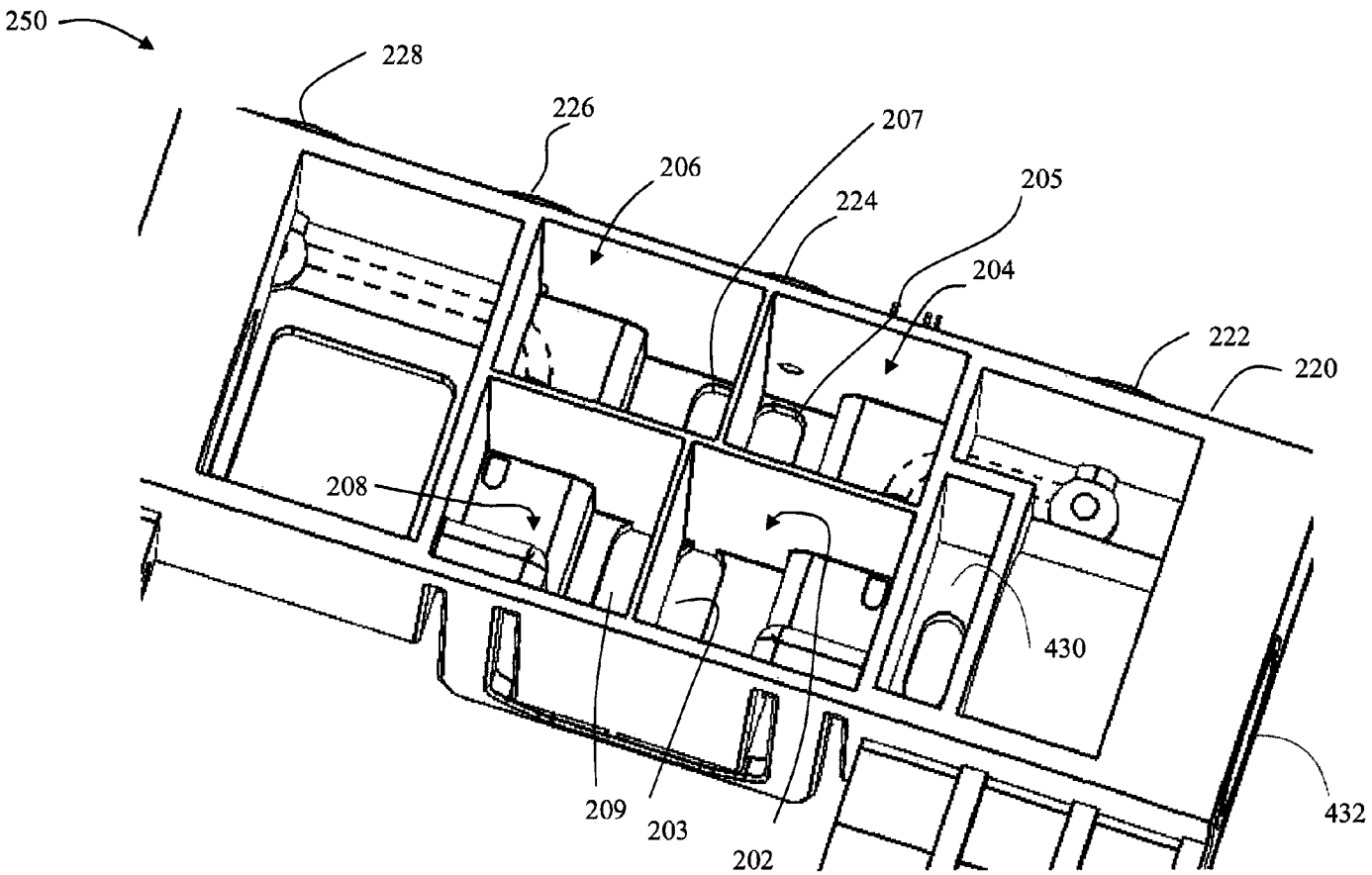
FIG. 7 is a close-up perspective view of a portion of the printhead frame of FIG. 4.
Figure 8:
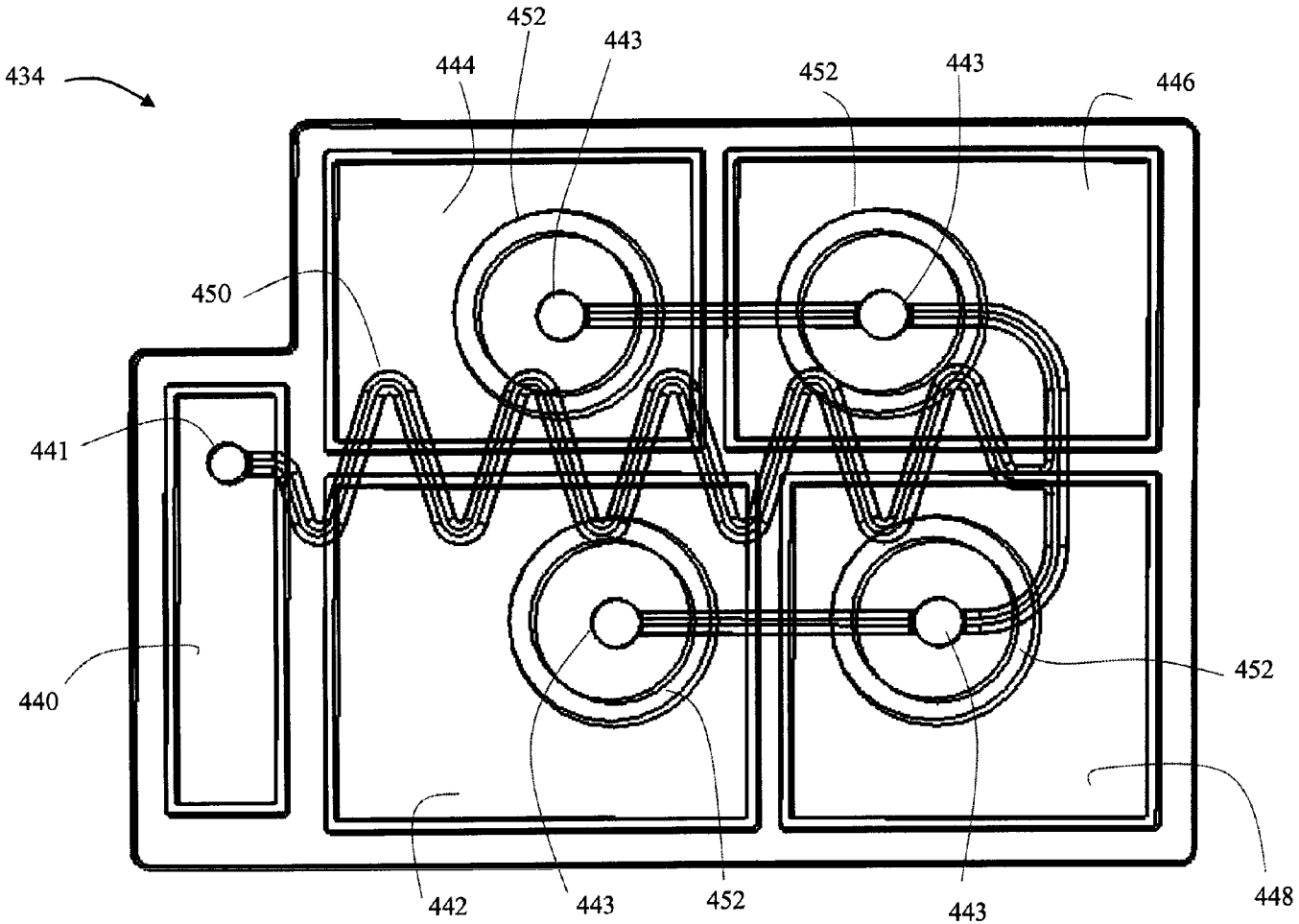
FIG. 8 is a transparent bottom view of a lid for ink chambers according to an embodiment of the invention.

FIG. 7 shows a close-up view printhead frame 250 in the region of ink chambers 202, 204, 206 and 208. Adjacent to ink chamber 202 is air extraction chamber 430. A reduced air pressure is provided to air extraction chamber 430 by pump connection 432. No pumping mechanism is shown in FIG. 7, but a bellows pump as described above, or other type of pump can be used. The reduced pressure from air extraction chamber 430 is provided to ink chambers 202, 204, 206 and 208 by lid 434, which is shown in a transparent bottom view in FIG. 8. Lid 434 includes compartment 440 to cover air extraction chamber 430 (see FIG. 7), compartment 442 to cover ink chamber 202, compartment 444 to cover ink chamber 204, compartment 446 to cover ink chamber 206, and compartment 448 to cover ink chamber 208. An air path 450, which can be a groove in the top surface of lid 434 connects air hole 441 corresponding to compartment 440 with air holes 443 at each of compartments 442, 444, 446 and 448. The groove and air holes 443 can be sealed off by a film (not shown) on top of lid 434 to contain air path 450. Compartments 442, 444, 446 and 448 each contain a rim 452.

Figure 9:
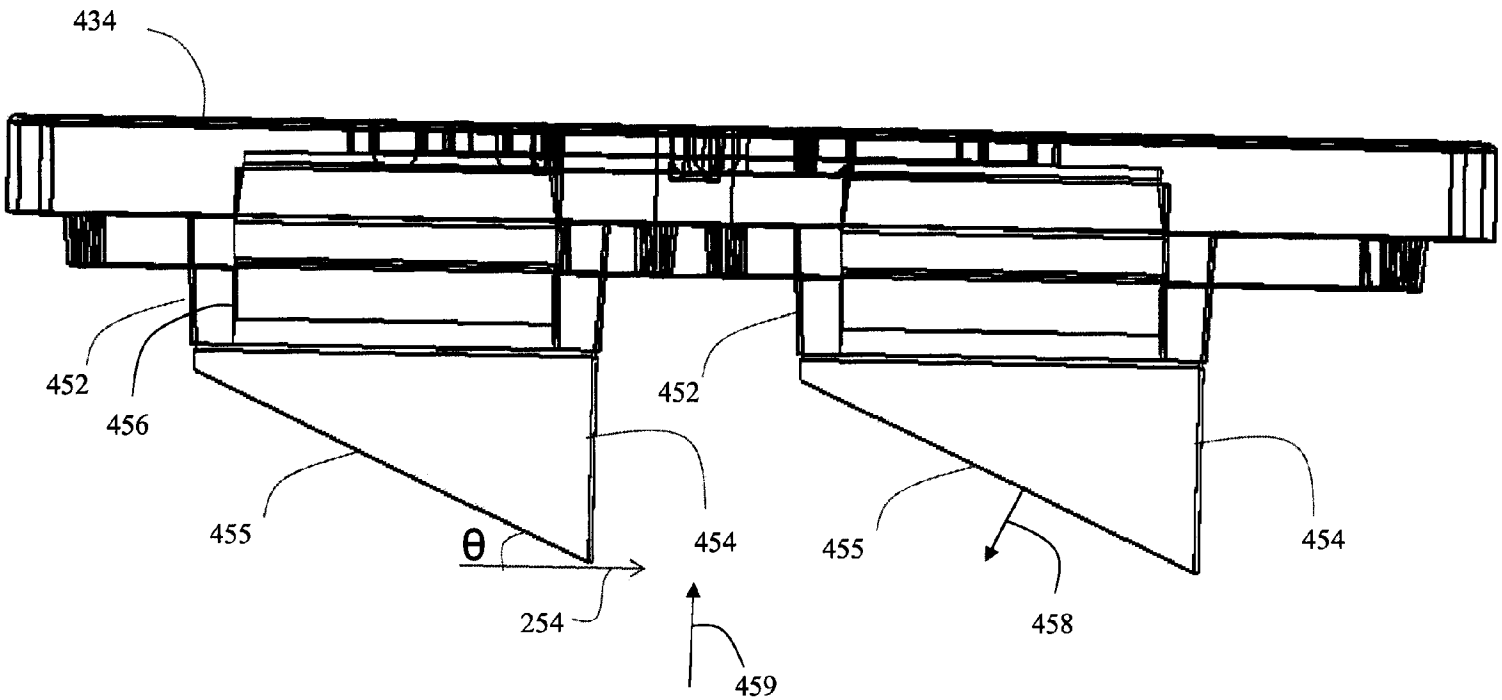
FIG. 9 is a side view of the lid of FIG. 8 together with inclined membrane mounts according to an embodiment of the invention.

FIG. 9 shows a side view of lid 434 with inclined membrane mounts 454 attached to rims 452 of lid 434. Inclined membrane mounts 454 include a mounting surface 455 that is inclined with respect to lid 434. Attached to each mounting surface 455 is an air permeable membrane 460 (not shown in FIG. 9). Also shown in FIG. 9 is nozzle array direction 254. Carriage guide direction is into and out of the page in the view of FIG. 9. Mounting surfaces 455, as well as the attached air permeable membranes, are inclined at an angle θ with respect to nozzle array direction 254. Because the printhead die 251 and nozzle arrays 253 (FIG. 3) are substantially in a horizontal plane when printhead frame 250 is installed in the printer, inclination of the mounting surfaces 455 and air permeable membranes with respect to nozzle array direction 254 enables gravity-assisted drainage of liquid ink from the surface of the air permeable membranes. In some embodiments of a compact design of printhead frame 250, the ink chambers 202, 204, 206 and 208 (FIG. 7) have a height of about 2 cm. A portion of this height will be occupied by ink when the printhead frame is installed in the printer and ink tanks 262 and 264 are installed. It is desired that the air permeable membranes 460 be suspended in the air space above the ink level. In order to configure the air permeable membranes 460 such that they do not occupy too large a portion of the height of the ink chambers, in some embodiments, it is preferred that the angle θ of inclination of the mounting surfaces 455 and air permeable membranes 460 be less than 30 degrees as shown in FIG. 9, rather than at a steeper angle. Arrow 458 indicates the normal to the plane of the membrane and arrow 459 indicates the vertical direction.

Figure 10:
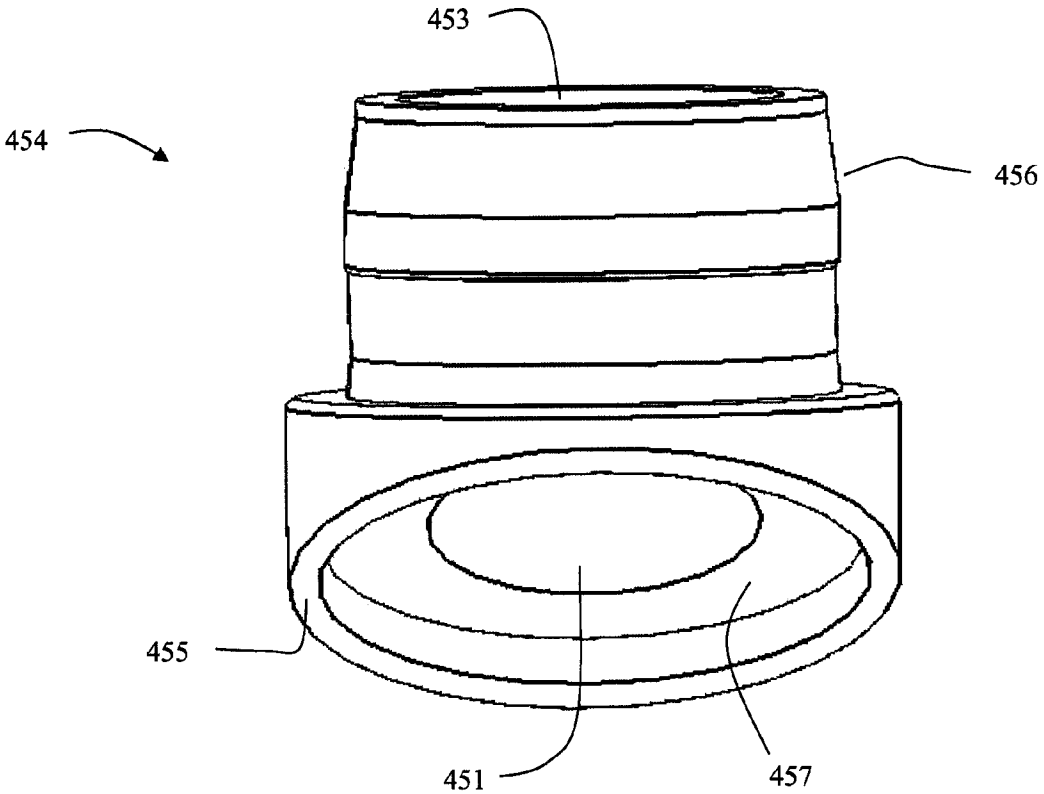
FIG. 10 is a front perspective view of an inclined membrane mount of FIG. 9.
Figure 11:
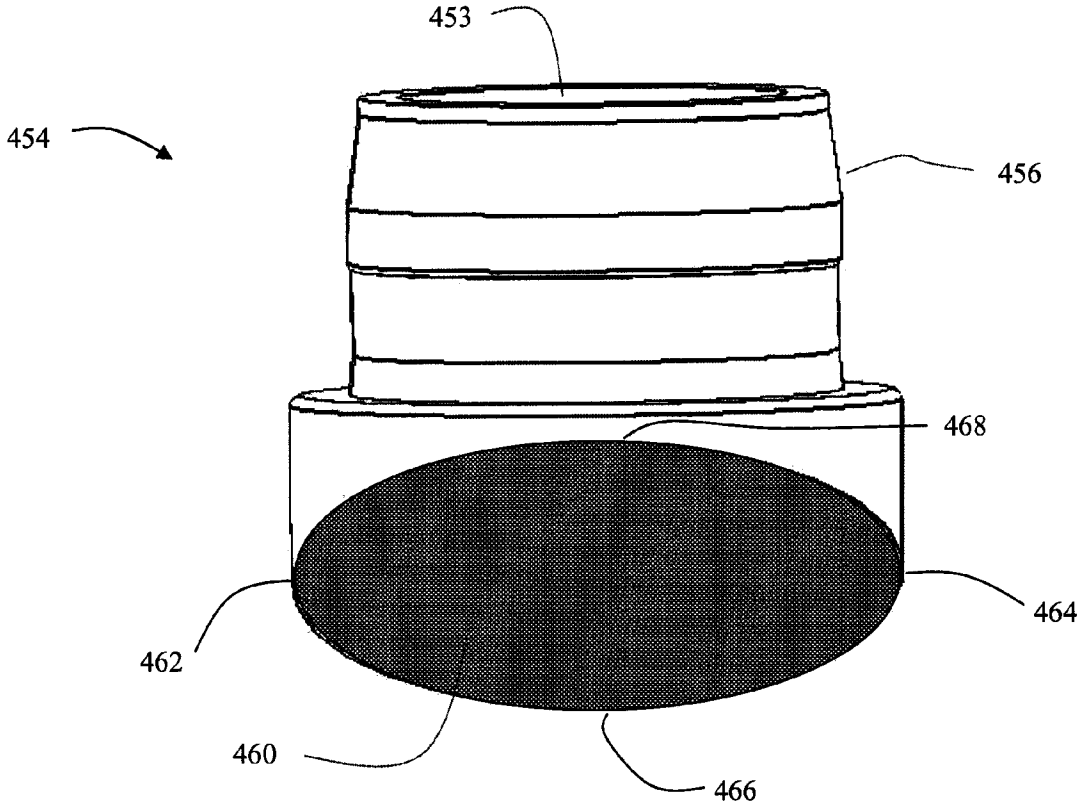
FIG. 11 is the inclined membrane mount of FIG. 10 with an air permeable membrane attached according to an embodiment of the invention.

FIG. 10 shows a front perspective view of inclined membrane mount 454 with no membrane attached. The inclined membrane mount 454 includes a conduit 457, an inclined membrane mounting surface 455, and attachment fitting 456. Conduit 457 forms an air passageway having an inlet end 451 through which air is extracted and an outlet end 453 from which air is discharged. FIG. 11 shows a similar view as FIG. 10, but with an air permeable membrane 460 attached to the mounting surface of inclined membrane mount 454. The side of air permeable membrane 460 that is attached to mounting surface 455 is next to the inlet end 451 of the air passageway (see FIG. 10). The other side of air permeable membrane 460 that is visible in FIG. 11 will face toward ink outlet 203, 205, 207, or 209 of corresponding ink chamber 202, 204, 206 or 208 in which the air permeable membrane 460 is suspended. Air passageway of conduit 457 is connected to an air hole 443 (FIG. 8) in the corresponding compartment of lid 434 to which inclined membrane mount 454 is attached. Thus, reduced air pressure from air extraction chamber 430 can be applied to the back side of air permeable membrane 460 so that air can be drawn from the ink chamber over which the membrane is suspended, through air permeable membrane 460 and air passageway of conduit 457, into air hole 443, along air path 450, through air hole 441, into air extraction chamber 430 and out pump connection 432. Also shown in FIG. 11 are a first lateral edge 462, a second lateral edge 464, a bottom edge 466 and a top edge 468 of inclined air permeable membrane 460.

Figure 12:
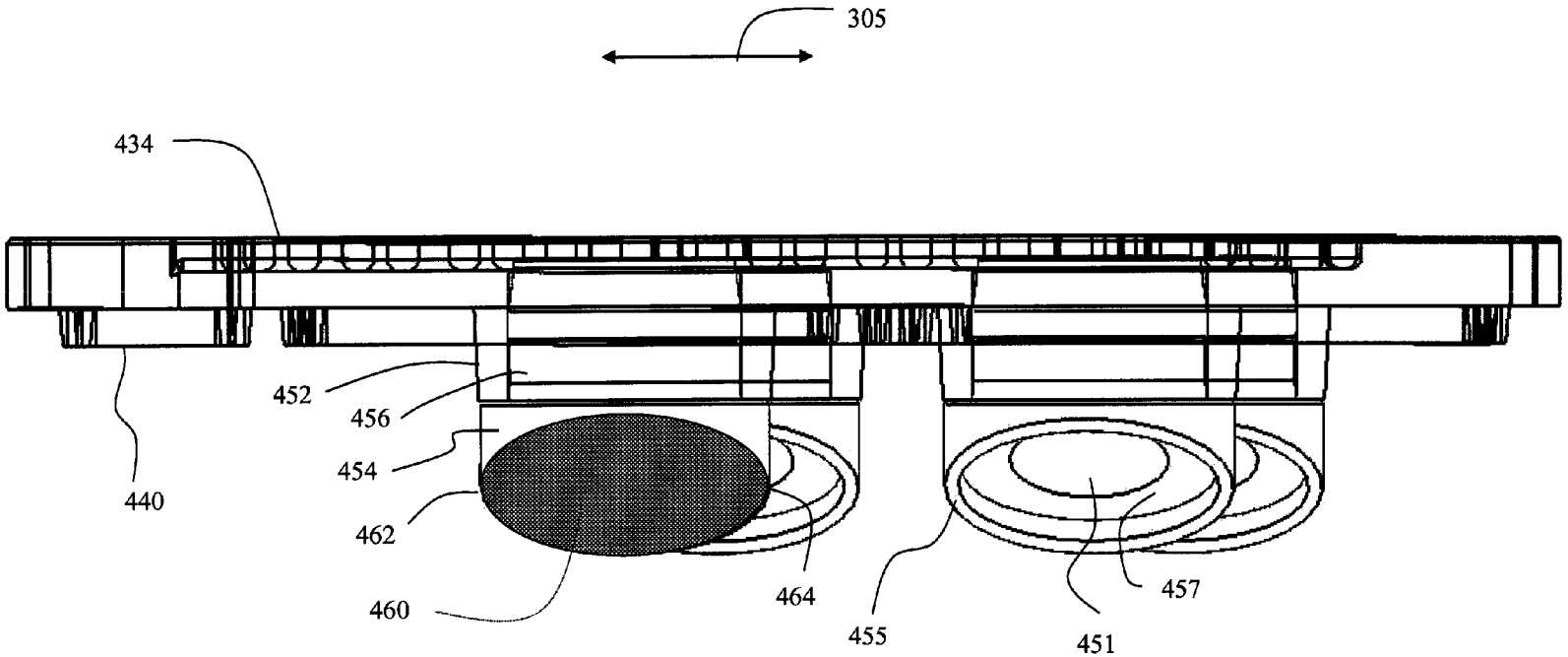
FIG. 12 is a front perspective view of four inclined membrane mounts attached to the lid of FIG. 8 according to an embodiment of the invention.

FIG. 12 shows a front view of four inclined membrane mounts 454 attached to lid 434. Only one of the inclined membrane mounts 454 is shown with an air permeable membrane 460 in FIG. 12 so that other features are more clearly seen. However, in practice, each of the inclined membrane mounts 454 would have an air permeable membrane 460 attached to mounting surface 455 next to inlet end 451 of air passageway of conduit 457. Also shown in FIG. 12 is the carriage guide direction 305. An important consideration in a carriage printer is how to orient an inclined membrane mount 454 such that not only gravity assists runoff of liquid ink from air permeable membrane 460, but also carriage acceleration and deceleration assists removal of liquid ink from air permeable membrane 460. It has been found in some embodiments that it is preferable to orient the inclined membrane mounts 454 such that carriage deceleration and acceleration at opposite ends of carriage travel tend to drive or shear liquid ink in the lateral direction (i.e. from first lateral edge 462 toward second lateral edge 464, and vice versa). In such embodiments it is found that lateral removal of liquid ink from air permeable membrane 460 is more effective than if the inclined membrane mounts 454 were oriented such that carriage deceleration and acceleration at opposite ends of carriage travel tended to drive liquid ink from the bottom edge 466 to top edge 468 and vice versa. In other words (with reference to FIGS. 7, 9 and 12), it is preferable in such embodiments for the air permeable membranes 460 to positioned at a height above the ink outlets 203, 205, 207 and 209 in corresponding ink chambers 202, 204, 206 and 208 respectively, such that the height of the membrane varies along the nozzle array direction 254, and such that the height of the membrane does not vary substantially along the carriage guide direction 305. An alternative way to describe the orientation of the membrane is that the membrane is held in a plane that has a normal 458 (FIG. 9), such that the normal 458 to the plane of the membrane is substantially parallel to a plane that is determined by the nozzle array direction 254 and the vertical direction 459.

Figure 13:
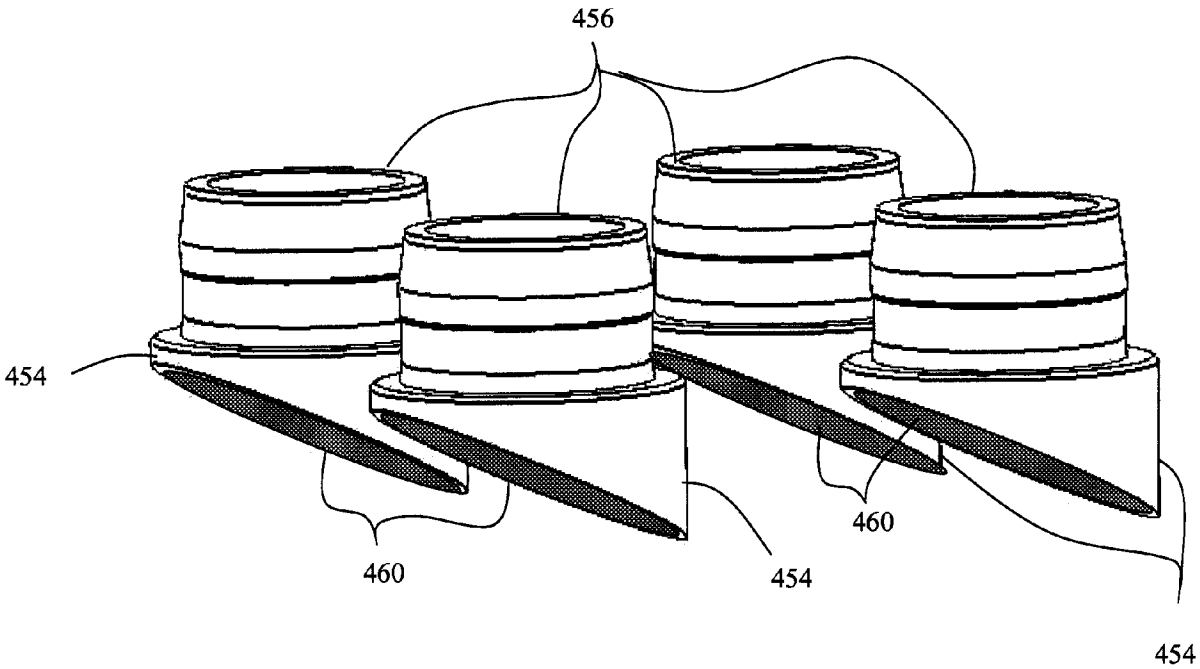
FIG. 13 shows the four inclined membrane mounts of FIG. 12 but without the lid.
Figure 14:
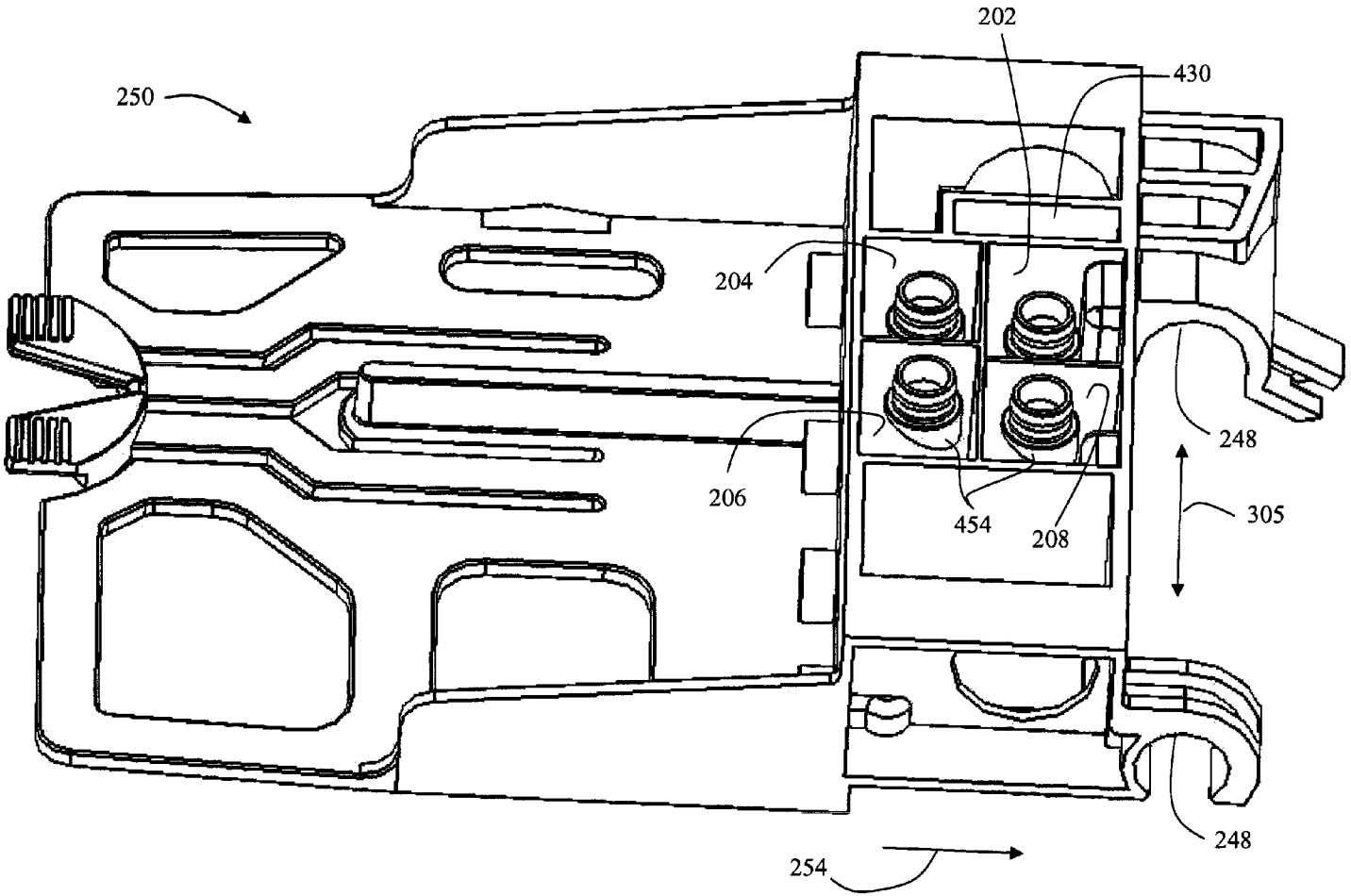
FIGS. 14 and 15 show the four inclined membrane mounts in relation to the ink chambers of the printhead frame of FIG. 4.
Figure 15:
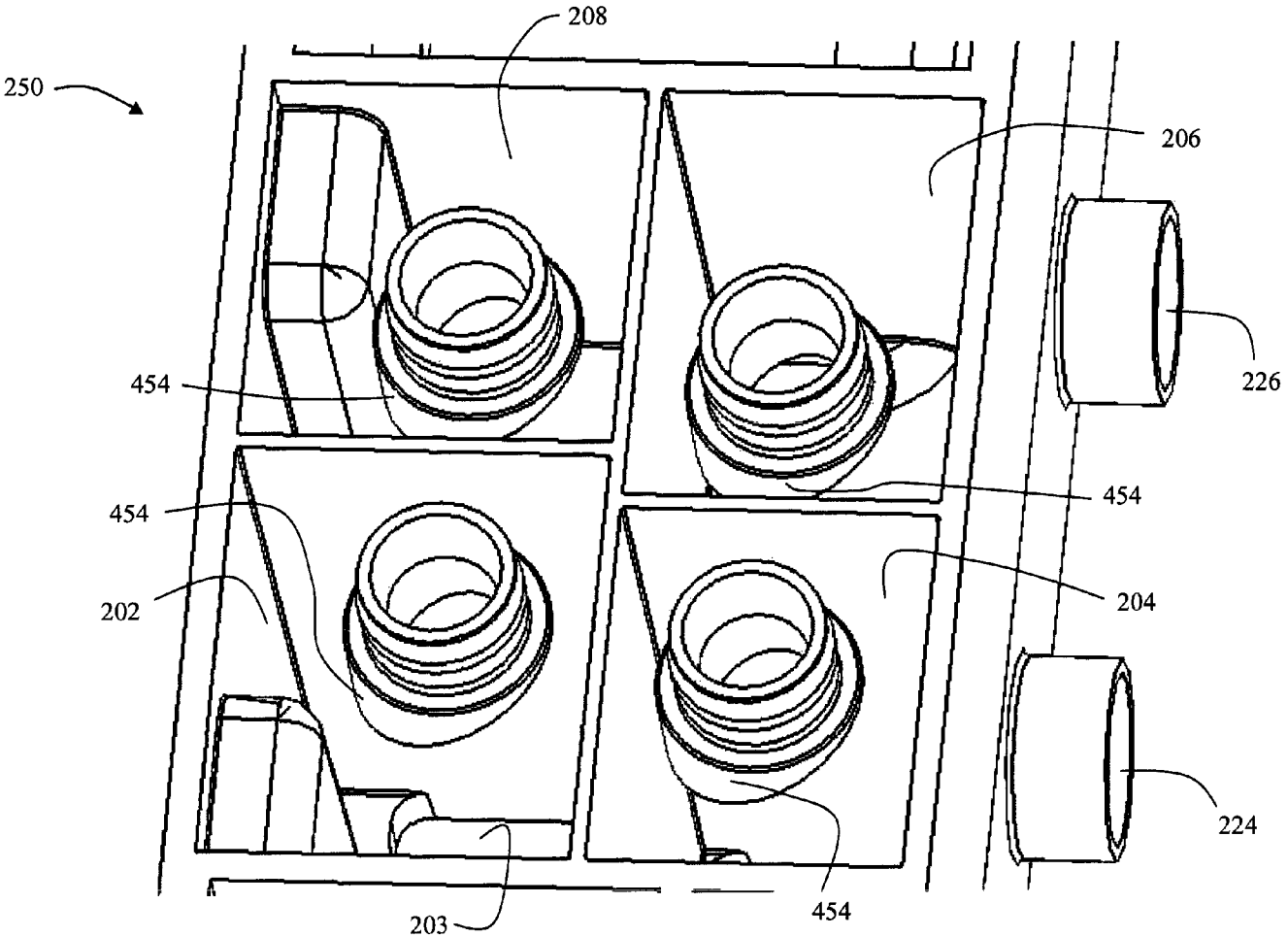

FIG. 13 shows a perspective view of four inclined membrane mounts 454 with air permeable membranes 460 attached, but with the lid 434 hidden from view. Although it is not required that each of the inclined air permeable membranes 460 is held substantially parallel to one another, in many embodiments that will be the case. FIG. 14 shows a perspective view of the four inclined membrane mounts 454 in their respective ink chambers 202, 204, 206 and 208 of printhead frame 250, but lid 434 is hidden from view so that the inclined membrane mounts 454 can be seen more clearly. Carriage guide direction 305, bearing surfaces 248, nozzle array direction 254 and air extraction chamber 430 are also shown. FIG. 15 shows a close-up perspective view of the four inclined membrane mounts in their respective ink chambers 202, 204, 206 and 208 of printhead frame 250, but lid 434 is hidden from view so that the inclined membrane mounts 454 can be seen more clearly.

Figure 16:
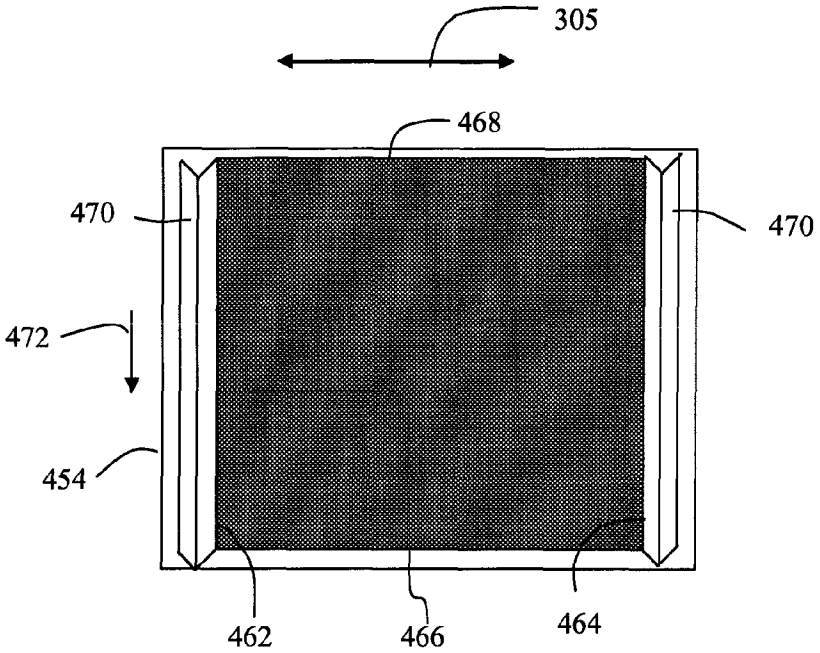
FIG. 16 shows the inclined membrane mount having a first and second gutter.

In some embodiments a gutter is incorporated into the inclined membrane mount 454, as shown schematically in FIG. 16. In the example of FIG. 16, there is a first gutter 470 adjacent first lateral edge 462 and a second gutter 470 adjacent second lateral edge 464 of air permeable membrane 460. As the liquid ink is driven laterally by carriage deceleration and acceleration at the end of travel in carriage guide direction 305, at least some of the liquid ink can flow into and down the gutters 470 so that it does not redistribute onto air permeable membrane 460 during the next oppositely directed deceleration and acceleration at the other end of carriage travel. Since the gutter 470 is part of inclined membrane mount 454, liquid ink will tend to flow along flow direction 472, from top edge 468 toward bottom edge 466. (Optionally, gutter(s) 470 can be inclined further relative to inclined membrane mount 454.) Although in some embodiments the air permeable membrane 460 has a circular or elliptical shape (FIG. 11), in embodiments including a gutter 470, a rectangular membrane shape can be preferable. In addition, in order to further facilitate flow of liquid ink into gutter 470 and down flow direction 472, in some embodiments the surface of the gutter 470 is made to be more wettable than a surface of the air permeable membrane 460.

Figure 17:
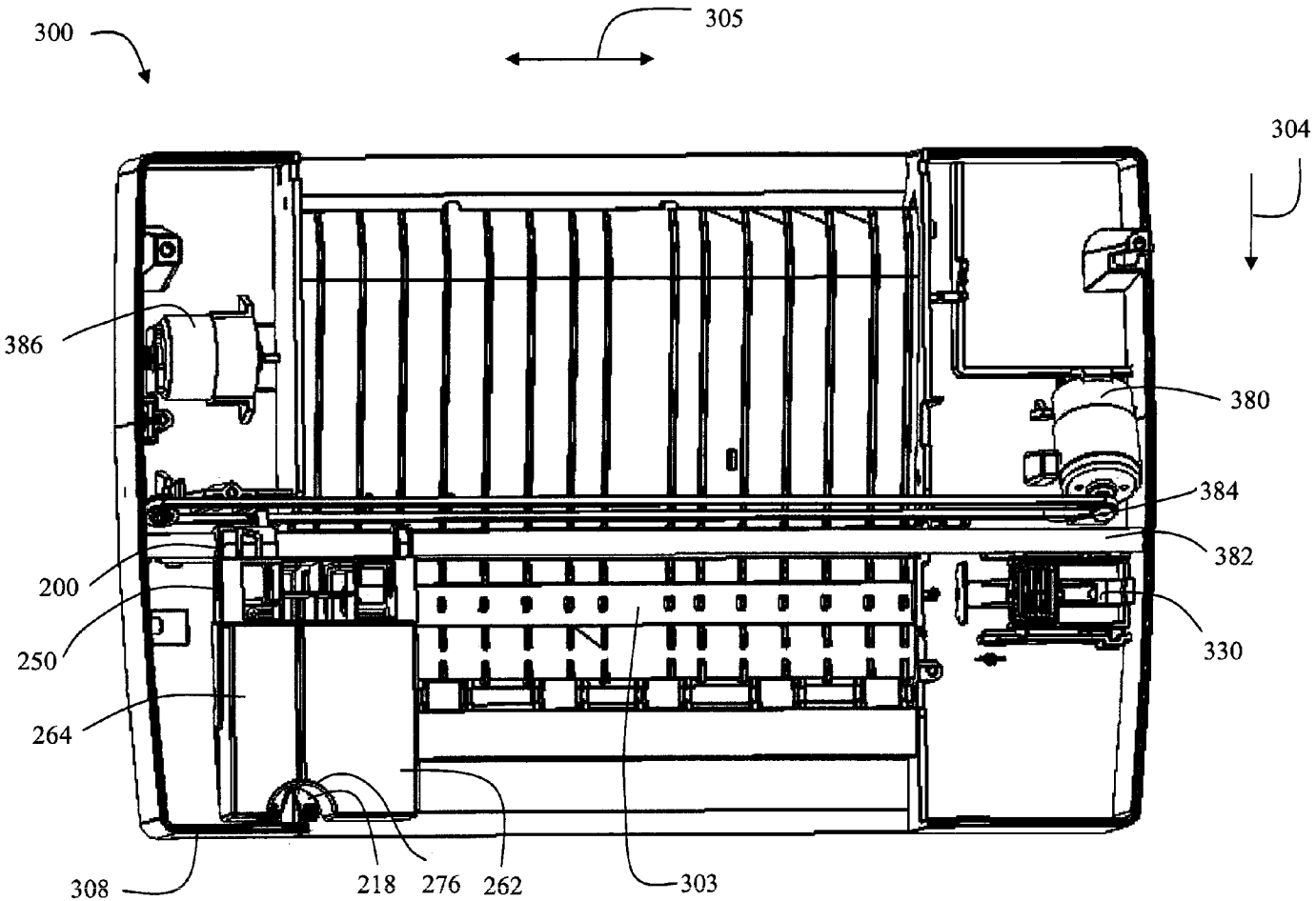
FIG. 17 is a top view of a portion of a carriage printer.

FIG. 17 shows a top view of a desktop carriage printer 300 according to an embodiment of the invention. Some of the parts of the printer have been hidden in the view shown in FIG. 17 so that other parts can be more clearly seen. Printer 300 has a print region 303 across which carriage 200 is moved back and forth in carriage guide direction 305, while drops are ejected from nozzle array 253 on printhead die 251 (not shown in FIG. 17) on printhead frame 250 that is mounted on carriage 200. Die mount substrate 310 (not shown in FIG. 17) is aligned to printhead frame 250 such that nozzle arrays 253 are disposed along a nozzle array (FIG. 2) direction 254 that is substantially perpendicular to carriage guide direction 305. In some embodiments, printhead frame 250 is integrally formed with carriage 200 as described above. Carriage motor 380 moves belt 384 to move carriage 200 along carriage guide 382. The pump mechanism, inclined membrane mounts 454, and lid 434 are not shown in FIG. 17.

Multichamber ink tank 262 and single chamber ink tank 264 are mounted in the holding receptacle of printhead frame 250. Tank latch 218 latches against wall 276 of multichamber ink tank 262. Printer 300 includes a base 309 on which the printer rests during operation (see FIGS. 18 and 19). The inclined membrane mounts 454 are not visible in FIGS. 18 and 19, but they would be inclined relative to base 309. A front wall 308 extends upward from base 309. To facilitate compact design and reduced cost of printer 300, the ends of tank latch 218 and tank latch 219 are disposed less than 5 mm from an interior surface of the front wall 308 of printer 300. The mounting orientation of printhead frame 250 is rotated relative to the view in FIG. 3, so that the printhead die 251 are located at the bottom side of printhead frame 250, the droplets of ink being ejected downward onto the paper or other recording medium (not shown) in print region 303. Paper advance motor 386 is shown but the various rollers that move the paper along media advance direction 304 are not shown in FIG. 17. Maintenance station 330 is provided for wiping and capping the nozzle face.

Figure 18:
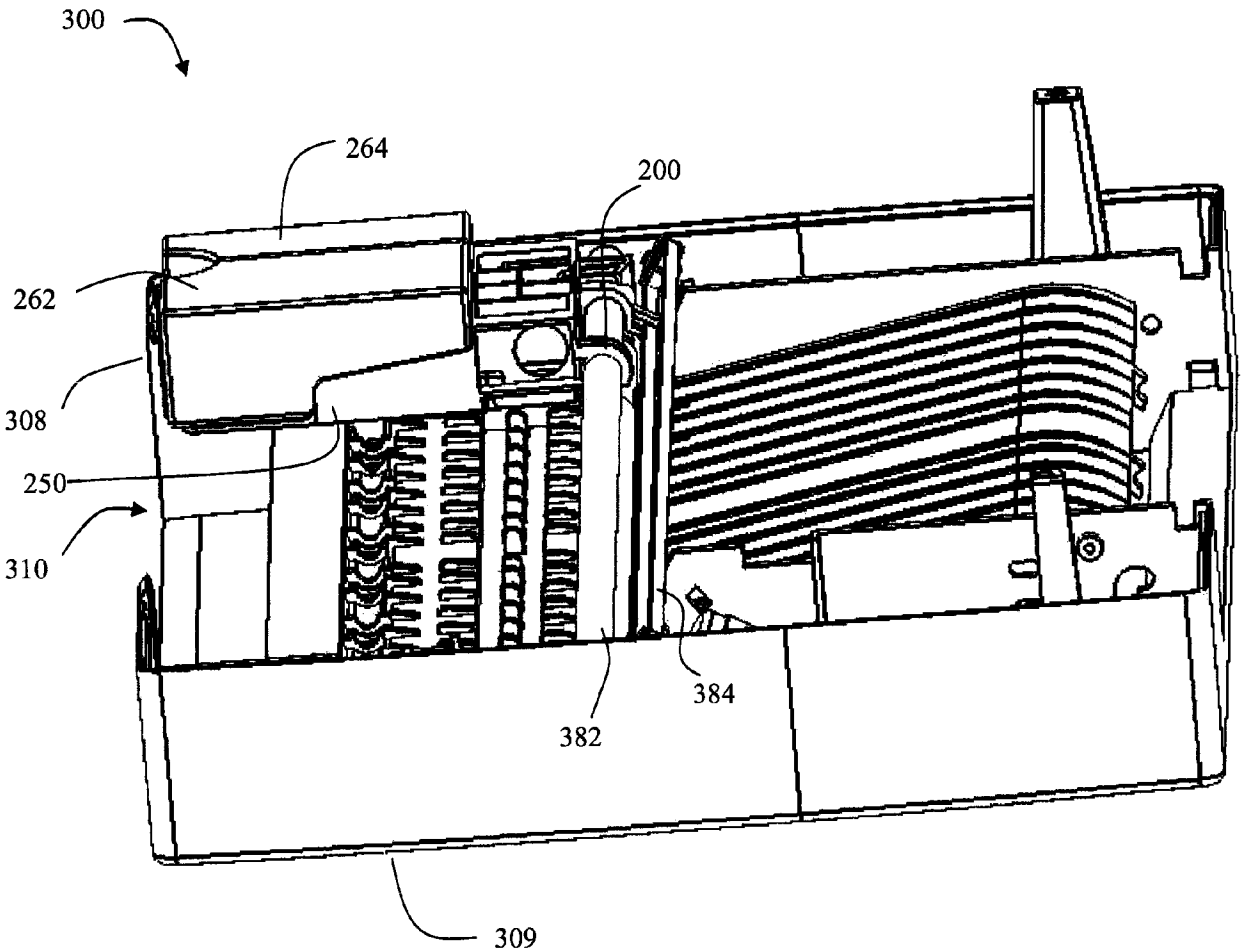
FIGS. 18 and 19 are perspective views of the carriage printer of FIG. 17.
Figure 19:
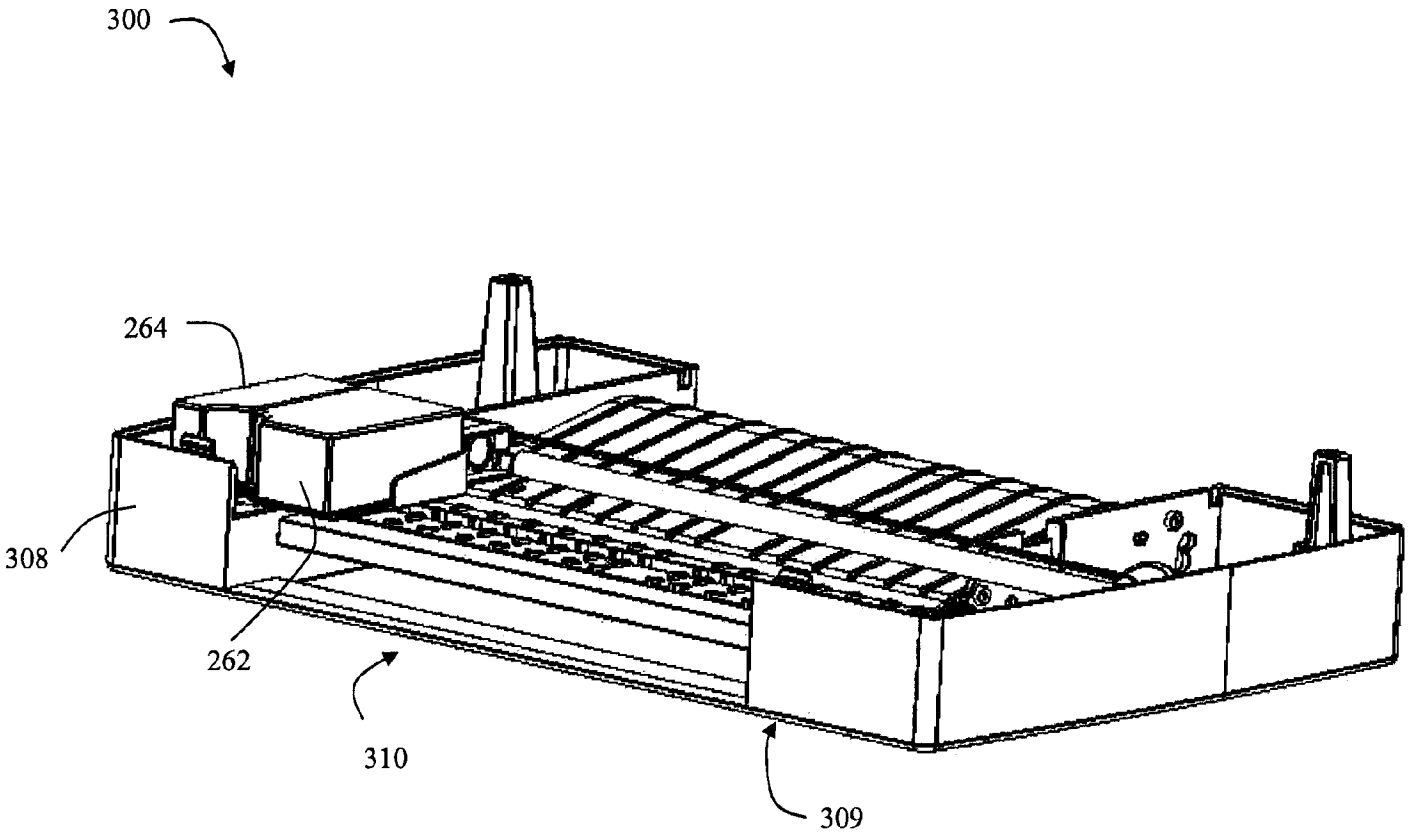

FIGS. 18 and 19 more clearly show front wall 308 of printer 300 and a doorway 310 through which the ink tanks 262 and 264 can be accessed for horizontal installation and removal. Printer 300 also includes a top surface (not shown), but the user can reach through doorway 310. Doorway 310 can consist of an opening as shown in FIGS. 18 and 19, or it can also optionally include a door (not shown) that the user can open in order to access the ink tanks 262 and 264. When an ink tank needs to be replaced, the carriage 200 is moved along carriage guide 382 until the ink tanks are located next to doorway 310. The user reaches through doorway 310 and releases the tank latch 218 or 219 corresponding to the ink tank 262 or 264 and grasps an end of the ink tank at the recessed connecting wall. The ink tank is then removed horizontally through the doorway 310. A replacement ink tank can then be inserted horizontally through doorway 310. The user can slide the replacement ink tank horizontally into the holding receptacle. After gently depressing the latching member as the ink tank is inserted into the holding receptacle, the latching member can be released so that it latches against the connecting wall 276 of the ink tank.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
202 Ink chamber
203 Ink chamber outlet
204 Ink chamber
205 Ink chamber outlet
206 Ink chamber

207 Ink chamber outlet
208 Ink chamber
209 Ink chamber outlet
210 Holding receptacle
211 First part (of holding receptacle)
212 Second part (of holding receptacle)
214 Base surface
215 First end
216 Second end
218 Tank latch
219 Tank latch
220 Wall
222 Ink inlet port
224 Ink inlet port
226 Ink inlet port
228 Ink inlet port
230 Partition
232 First sidewall
234 Second sidewall
242 Pressing direction
248 Bearing surface
250 Printhead frame
251 Printhead die
253 Nozzle array
254 Nozzle array direction
262 Multi-chamber ink tank
264 Single-chamber ink tank
272 End wall (of ink tank)
276 Wall (of ink tank)
290 Air extraction device
292 Bellows
294 One-way relief valve
295 Compression direction
296 Projection
300 Printer
303 Print region
304 Media advance direction
305 Carriage scan direction
306 Wall
308 Front wall (of printer)
309 Base (of printer)
310 Die mount substrate
312 Die mount surface
330 Maintenance station
332 Cap
360 Ink delivery surface
371 Piece of recording medium
380 Carriage motor
382 Carriage guide
383 Encoder strip
384 Belt
386 Paper advance motor
387 Feed roller
388 Passive roller(s)
389 Discharge roller
390 Electronics board
430 Air extraction chamber
432 Pump connection
434 Lid
440 Compartment
441 Air hole
442 Compartment
443 Air hole
444 Compartment
446 Compartment
448 Compartment
450 Air path
451 Inlet end
452 Rim
453 Outlet end
454 Inclined membrane mount
455 Mounting surface
456 Attachment fitting
457 Conduit
458 Normal (to plane of membrane)
459 Vertical direction
460 Air permeable membrane
462 First lateral edge (of inclined membrane)
464 Second lateral edge (of inclined membrane)
466 Bottom edge (of inclined membrane)
468 Top edge (of inclined membrane)
470 Gutter
472 Flow direction

The invention claimed is:

1. An inkjet printhead assembly for use in an inkjet printer, the inkjet printhead assembly comprising:

an array of nozzles disposed along a nozzle array direction;

an ink chamber including an ink outlet that is fluidly connected to the array of nozzles; and an air-permeable membrane positioned in the ink chamber at an angle that is inclined relative to the nozzle array direction.

2. The inkjet printhead assembly of claim 1, the membrane including a first side that faces toward the ink outlet and a second side opposite the first side, and further comprising a mounting structure including an air passageway proximate the second side of the membrane.

3. The inkjet printhead assembly of claim 2 further comprising an air extraction chamber that is connected to the air passageway proximate the second side of the membrane.

4. The inkjet printhead assembly of claim 2, wherein the mounting structure comprises a gutter adjacent to the membrane.

5. The inkjet printhead assembly of claim 4, wherein a surface of the gutter is more wettable than a surface of the membrane.

6. The inkjet printhead assembly of claim 1, wherein the membrane is positioned at a height above the ink outlet, wherein the height of the membrane varies along the nozzle array direction.

7. The inkjet printhead assembly of claim 2, wherein the mounting structure comprises a first gutter adjacent a first edge of the membrane and a second gutter adjacent a second edge of the membrane.

8. The inkjet printhead assembly of claim 1, wherein the membrane is held in a plane having a normal that is substantially parallel to a plane determined by the nozzle array direction and a vertical direction.

9. The inkjet printhead assembly of claim 1, the array of nozzles being a first array, the ink chamber being a first ink chamber, and the membrane being a first membrane, the printhead assembly further comprising:

a second array of nozzles disposed along the nozzle array direction;

a second ink chamber including an ink outlet that is fluidly connected to the second array of nozzles; and a second air-permeable membrane positioned in the second ink chamber at an angle that is inclined relative to the nozzle array direction.

10. The inkjet printhead assembly of claim 9, wherein the second membrane is held substantially parallel to the first membrane.

11. The inkjet printhead assembly of claim 9 further comprising: (a) a mounting structure having a first air passageway proximate the first membrane and a second air passageway proximate the second membrane; and (b) an air extraction chamber that is connected to the first air passageway and the second air passageway.

12. The inkjet printhead assembly of claim 9 further comprising a mounting structure comprising:

a lid that covers the first ink chamber and the second ink chamber;

a first mounting member including a mounting surface that is inclined with respect to the lid; and a second mounting member including a mounting surface that is inclined with respect to the lid.

13. An inkjet printer comprising:

a carriage guide including a carriage guide direction;

a printhead assembly that is movable back and forth along the carriage guide direction, the printhead assembly comprising:

an array of nozzles disposed along a nozzle array direction;

an ink chamber including an ink outlet that is fluidly connected to the array of nozzles; and an air-permeable membrane positioned in the ink chamber at an angle that is inclined relative to the nozzle array direction.

14. The inkjet printer of claim 13, wherein the membrane is positioned at a height above the ink outlet, wherein the height of the membrane varies along the nozzle array direction.

15. The inkjet printer of claim 13, wherein the membrane is positioned at a height above the ink outlet, wherein the height of the membrane does not vary substantially along the carriage guide direction.

16. The inkjet printer of claim 13 further comprising a mounting structure comprising a gutter adjacent to the membrane.

17. The inkjet printer of claim 16, wherein the mounting structure comprises a first gutter adjacent a first edge of the membrane and a second gutter adjacent a second edge of the membrane.

18. The inkjet printer of claim 13, the array of nozzles being a first array, the ink chamber being a first ink chamber, and the membrane being a first membrane, wherein the printhead assembly further comprises:

a second array of nozzles disposed along the nozzle array direction;

a second ink chamber including an ink outlet that is fluidly connected to the second array of nozzles; and a second air-permeable membrane positioned in the second ink chamber at an angle that is inclined relative to the nozzle array direction.

19. The inkjet printer of claim 18 further comprising a mounting structure comprising:

a lid that covers the first ink chamber and the second ink chamber;

a first mounting member including a mounting surface that is inclined with respect to the lid; and a second mounting member including a mounting surface that is inclined with respect to the lid.

20. The inkjet printer of claim 19 further comprising:

a pump that is activatable along the carriage guide direction;

an air extraction chamber that is connected to the pump;

a first air passageway proximate the first membrane; and a second air passageway proximate the second membrane, wherein the first air passageway and the second air passageway are connected to the air extraction chamber.

21. The inkjet printer of claim 20, wherein the lid also covers the air extraction chamber.

22. The inkjet printer of claim 21, wherein the lid includes an air path that connects the first air passageway and the second air passageway to the air extraction chamber.

23. An inkjet printhead assembly for use in an inkjet printer, the inkjet printhead assembly comprising:

an array of nozzles disposed along a nozzle array direction;

an ink chamber including an ink outlet that is fluidly connected to the array of nozzles;

an inclined membrane mount forming a conduit having an air inlet end and an air outlet end, wherein the air inlet end includes an inclined mounting surface; and an air-permeable membrane positioned on the inclined mounting surface.

* * * * *